United States Patent [19]

Richards

[11] 3,955,797

[45] May 11, 1976

[54] SWIMMING POOL LIFT

[75] Inventor: Lawrence I. Richards, Elk Grove Village, Ill.

[73] Assignee: Autoquip Corporation, Chicago, Ill.

[22] Filed: Jan. 24, 1974

[21] Appl. No.: 436,035

[52] U.S. Cl. ..... 254/89 H; 4/172.13; 254/93 R

[51] Int. Cl.[2] ..... E04H 3/19

[58] Field of Search ..... 254/89 H, 93 R; 4/185 L, 172.13; 61/65, 1

[56] References Cited

UNITED STATES PATENTS

| | | | |
|---|---|---|---|
| 2,779,949 | 2/1957 | Crispen | 254/93 R X |
| 2,942,848 | 6/1960 | Friesen | 254/89 H |
| 3,413,661 | 12/1968 | Ross | 4/172.13 |

FOREIGN PATENTS OR APPLICATIONS

| | | | |
|---|---|---|---|
| 1,194,924 | 6/1970 | United Kingdom | 4/172.13 |
| 719,244 | 12/1954 | United Kingdom | 4/185 L |
| 705,811 | 3/1954 | United Kingdom | 4/185 L |

*Primary Examiner*—Al Lawrence Smith
*Assistant Examiner*—Robert C. Watson
*Attorney, Agent, or Firm*—Darbo, Robertson & Vandenburgh

[57] ABSTRACT

A platform positioned in a swimming pool has a slave hydraulic ram at each corner which raise and lower the platform. Each ram has a barrel attached to the platform and a piston rod which is supported on the bottom of the pool. There is a hydraulic motor for each slave ram. The hydraulic fluid in this system is water. Each hydraulic motor comprises a cylinder with a piston therein. Each time that the pistons of the motor cylinders are retracted make-up water flows into the system from a tank. The pistons of the motor cylinders are actuated in unison by a single main cylinder. The main cylinder is operated by hydraulic fluid from a hydraulic pump through a control valve.

9 Claims, 5 Drawing Figures

TO FRESH WATER SUPPLY

SWIMMING POOL LIFT

BACKGROUND AND SUMMARY OF THE INVENTION

At many locations at which there is a swimming pool it is important that the physically handicapped have an opportunity to use the pool. However, getting the physically handicapped into and out of the pool can be troublesome. A pool can be constructed with a wheel chair ramp but, for one reason or another, many are not. Ramps are not necessarily the ideal solution even when the problem is anticipated at the time that the pool is constructed.

Platforms (elevators) which move vertically in the pool have been proposed as a solution to this problem. However, the power means for moving the platform vertically have not been entirely satisfactory. One form of a power means has been chains or cables which are actuated by a winch or a hydraulic cylinder, etc., located outside the pool. This has the advantage that the oil employed in and around the winch, hydraulic cylinder, etc., will not contaminate the pool. For the same reason the chain or cables and any of the pulleys therefor which are in or above the pool cannot be lubricated. In addition to that minor disadvantage, there is a major disadvantage from the standpoint of safety. It is very difficult to arrange chains or cables in a manner such that they are not accessible to mischievous children who can be injured by grasping them while the platform is moving, etc. Such systems suffer from a further disadvantage that they require a great deal of maintenance and attendant expense.

Another form of power means has been some form of hydraulic cylinder directly attached to the platform to raise and lower the platform. Since it is nearly impossible to prevent a hydraulic cylinder from leaking, the usual hydraulic fluids must be avoided since they are oily and will contaminate the water in the pool. Also, the use of hydraulic cylinders can result in complications due to uneven loads on the platforms. It is not practical to anticipate that the platform will be uniformly loaded. Thus the apparatus should be capable of accepting unequal load, e.g., more on one side than on the other. While a single ram can stand a limited amount of non-uniform loading, the more there is the larger must be the ram and the greater is the wear and tear on the ram bearings, etc. Even when using a multiplicity of rams, an unequal loading can cause the ram closest to the heavy loading to act as a pump supplying hydraulic fluid to the lightly loaded side, thus just increasing the effect of the unequal loading.

The present invention relates to a simplified apparatus for supplying the force to raise and lower a platform in a swimming pool. It has the advantages that: it is dependable; it does not become inordinately expensive; it can be easily adapted to lifts installed in new or existing pools of almost any shape; and it will have an excellent service life, even under conditions of unequal loading of the platform. An important feature of the invention is that water is used in the hydraulic system of the cylinders which do the actual raising and lowering of the platform. Thus there is no contamination of the pool due to leakage. A simple arrangement is provided to keep this hydraulic system filled with water by always adding the required amount of make-up water. Further objects and advantages will become apparent from the following description.

DESCRIPTION OF SPECIFIC EMBODIMENT

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

Figure 1:
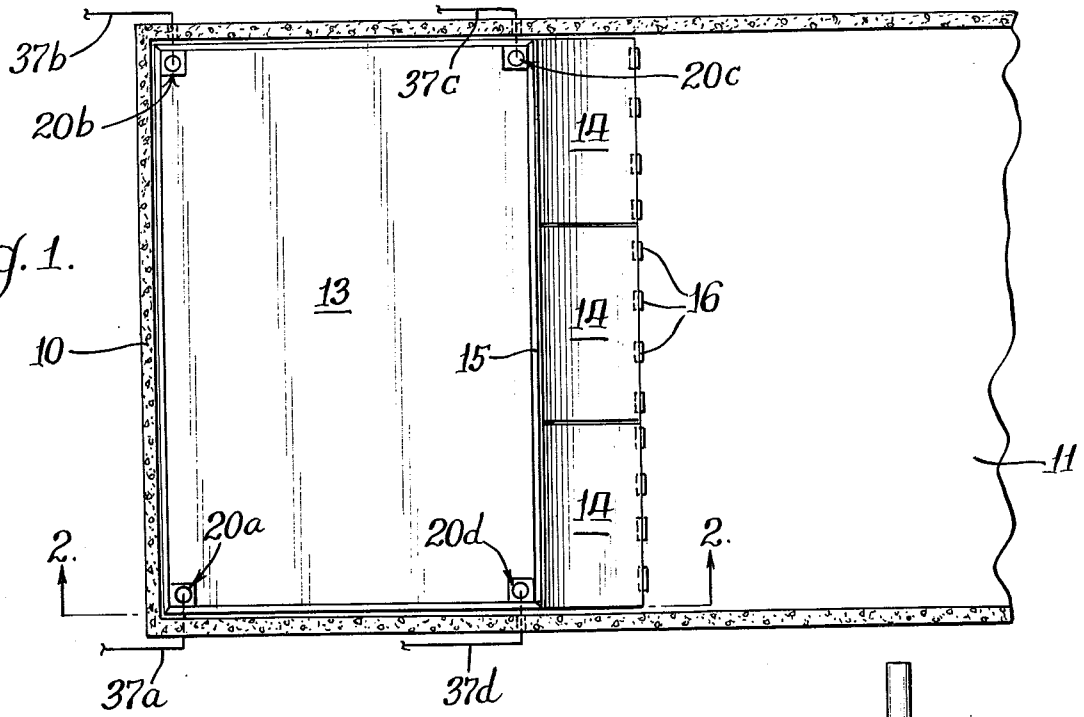
FIG. 1 is a plan view of a portion of a swimming pool incorporating an embodiment of the present invention.
Figure 2:
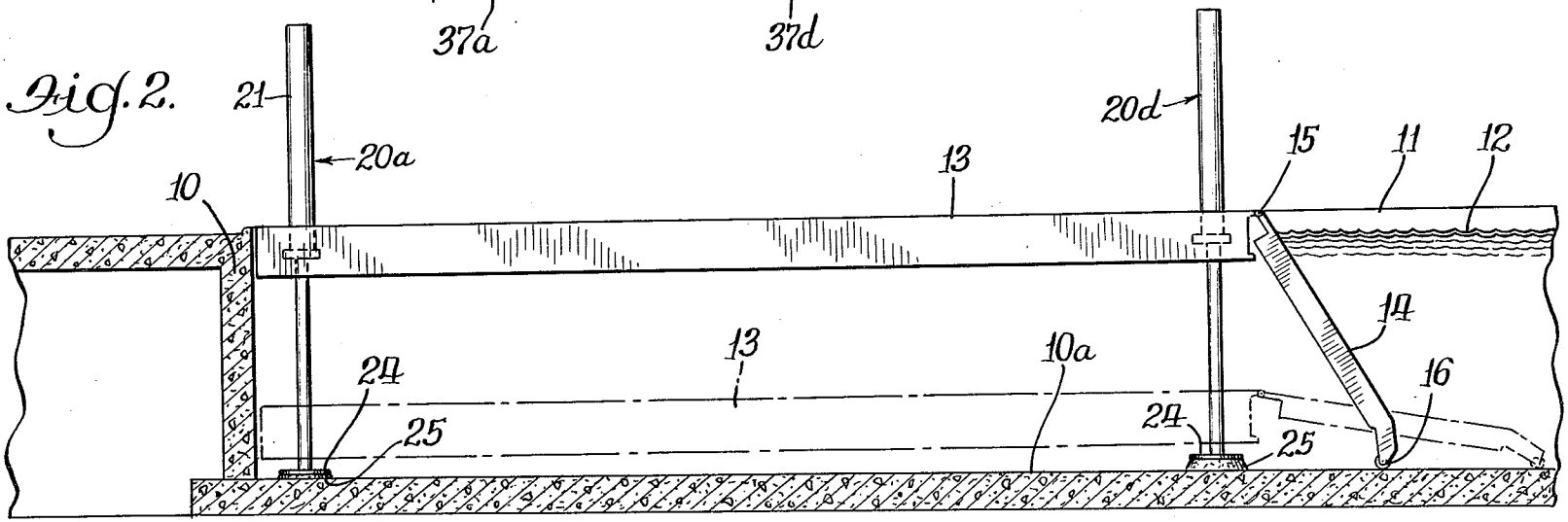
FIG. 2 is a section as seen at line 2—2 of FIG. 1.

FIGS. 1 and 2 illustrate a concrete swimming pool body 10 which defines an open top chamber 11 holding water 12 to form the swimming pool. Within the chamber or pool is a vertically movable platform 13. Suitable guard rails, not shown, will normally be provided around the platform. The platform is positioned at one end of the pool and does not entirely fill the pool area. On the exposed side of the platform there are a plurality of ramps 14. These have their proximal sides connected by hinges 15 to the platform. At the opposite or distal side the ramps have rollers 16 which ride on the bottom 10*a* of the pool body. As will be seen from FIG. 2, when the platform is in the lowered position these ramps are approximately horizontal and aid in moving on and off the platform. When the platform is in the raised position, the ramps are upright and act as a shield to prevent someone from entering the space below the platform where that person might get trapped and injured if the platform were lowered.

In each corner of the rectangular platform 13 is a slave lifting ram, generally 20*a*, 20*b*, 20*c* and 20*d*. These rams are identical and only that designated 20*a* will be described in detail. It comprises a barrel 21 defining a cylinder. The closed end of the barrel is up. Within that cylinder is a piston 22. A piston rod 23 extends downwardly from the piston to outside the barrel. The piston rod has a support plate 24 on the end thereof. A layer 25 of epoxy cement or the like is put between the support plate 24 and the pool bottom 10*a*. The purpose of this cement is to fix the position of the plate and also to level the four such plates in a common horizontal plane above the pool bottom. The barrel is affixed to the platform.

There are four positive displacement hydraulic motors, generally 28*a*, 28*b*, 28*c* and 28*d*, there being a respective motor for each of the rams. Again, these are identical and only that designated 28*a* will be described in detail. A motor 28*a* comprises a barrel 29 defining a cylinder cavity 30. Axially movable within this cavity is a piston and piston rod 31. Between the barrel and the piston-piston rod are a bearing 32 and seals 33. Adjacent the inner end of the piston-piston rod it has a peripheral groove 34. A passageway 35 extends from this groove to the end 36 of the piston-piston rod. Conduits 37*a*, 37*b*, 37*c* and 37*d* extend from hydraulic connections 42 at the closed end of the respective barrels to the interior of the barrel of the respective slave ram, with a portion of the passageway being through the piston rod and piston of the ram, the conduit connecting with a hydraulic connection 43 at the outer end of the ram. At a location at which it will be opposite the position of groove 34 when the piston 31 is at its furthest displaced position from the barrel is a piping connector 38*a*. Corresponding connectors 38*b*, 38*c* and 38*d* are used on the other motors. A conduit 39 extends from each of these piping connectors to an elevated water supply tank 40. A float valve arrangement 41 keeps this tank full of water from the available domestic water supply to serve as make-up water.

A header 45 connects the piston rods (corresponding to 31) of the hydraulic motors for movement in unison. Also connected to this header is the piston rod 46 of a main hydraulic cylinder, generally 47. This is a double acting cylinder and is connected by pipes 48 and 49 to a solenoid operated, four-way valve, generally 50. This valve has centering springs 51 and is moved one way when solenoid 52 is energized and is moved the other way when solenoid 53 is energized. Solenoids 52 and 53 are part of a transformer powered low voltage control circuit. Thus, the actuating switches for that circuit can be put on the platform or adjacent the pool without danger. A hydraulic pump 56 is driven by an electric motor 57. The pump picks up hydraulic fluid from a sump 58 through a pipe 59. Pipe 59 has a strainer 60 therein. The pump discharges the hydraulic fluid into a pipe 61 leading to a check valve 62 and a pressure relief valve 63. A pipe 64 extends from check valve 62 to the four-way valve 50. A pipe 65 extends from the pressure relief valve 63 to the sump. A pipe 66 extends from the four-way valve 50 to the sump.

All of this power apparatus except the rams 20 and part of the conduits 37 leading thereto are remote from the pool. For example, in a new construction a vault or motor room adjacent the pool can be provided to house this power apparatus. Thus it can be easily serviced if required. The lifting rams 20 will require little servicing, but they also are readily accessible. The hydraulic fluid in the system which includes pump 56 and the main cylinder 47 is conventional hydraulic fluid, e.g. oil. There is no possibility of this hydraulic fluid contaminating the pool.

Assuming that it is desired to lower the platform 13, a suitably located electrical switch (not shown) is actuated to energize the appropriate solenoid to move the four-way valve 50 to the position such that the main cylinder 47 withdraws the pistons (corresponding to 31) as far as possible from the barrels of the hydraulic motors 28. This is the position illustrated in FIG. 4. This allows all the water from the barrels (corresponding to 21) of rams 20 to be withdrawn thus permitting the pistons (corresponding to 22) to move the greatest distance into the cylinder. An intermediate stop at any location can be made merely by releasing the electrical switch so that the solenoid is deenergized. Thereupon springs 51 will center the four-way valve 50 to lock the main cylinder 47. This in turn locks the four hydraulic motors 28. When it is desired to raise the platform, the suitably located electrical switch is closed to energize the other solenoid and position the four-way valve so that hydraulic fluid under pressure is applied to pipe 48 and pipe 49 is permitted to drain back to the sump 58. This causes the piston rod 46 to move to the right in FIG. 3. In response thereto, the hydraulic motors 28 force water into the barrels 20 thereby moving the pistons outwardly from the barrels of the slave rams.

Figures 3, 4, 5:
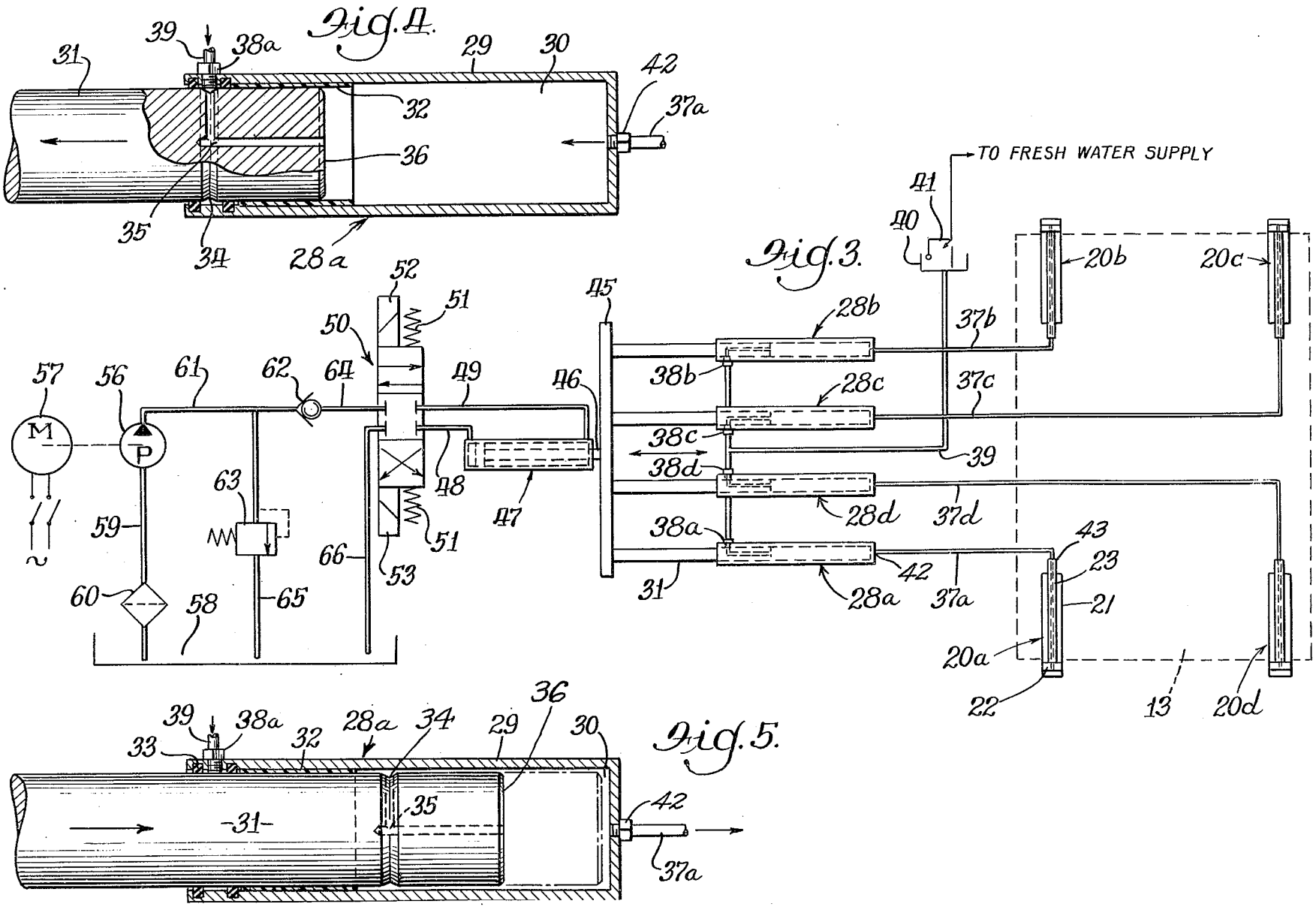
FIG. 3 is a diagrammatic view of the apparatus for raising and lowering the platform.
FIG. 4 is a longitudinal section through one of the hydraulic motors which actuate a respective lifting ram, with the piston fully extended for the intake of make-up water.
FIG. 5 is a view similar to FIG. 4 showing the piston in the process of moving into the cylinder barrel such as occurs when the pool platform is being raised.

When the pistons of the motors 28 move to the position at which they are fully extended from the barrels, as illustrated in FIG. 4, groove 34 comes into alignment with the conduit 39 leading to the tank 40. If there has been any leakage of the water from the slave hydraulic system, this water will be replaced by water flowing by gravity from tank 40 (i.e. make-up water). All or most of any air trapped within the cylinder cavity 30 will rise through the conduit 39 to be expelled through the open top of tank 40. When the pistons (corresponding to 31) move only a short distance back into the cylinder cavities 30, the groove 34 and the conduit 39 are no longer in communication. Thus the water in the slave hydraulic system is trapped therein and the refill conduit 39 is cut off. This situation is illustrated in FIG. 5.

The refill fluid in tank 40 for the slave hydraulic system should be compatible with the liquid in the pool. The most obvious example is where it is the identical fluid. This need not necessarily be the case however, particularly where the fluid loss is minimal. For example, fresh water might be employed as a make-up fluid in a salt water pool.

Assuming that header 45 is sufficiently rigid (or so mounted) that it will have no deflection, then an uneven load applied to one area of the platform 13 will not cause the ram feeling the excess load to act as a pump with respect to the other rams. Thus, for example, assume that an extra heavy load is applied in the area of platform 13 most nearly adjacent rams 20*a* and 20*d*. While this extra load will be reflected as a force on motors 28*a* and 28*d*, there will be no movement. The header 45 will stay in the same position due to the incompressability of the hydraulic fluid and the fact that it is trapped in the respective slave hydraulic system (comprising one of each of rams 20, conduits 37 and motors 28). Each time that the platform is fully lowered, any water loss in the slave hydraulic system is automatically replaced from tank 40. Should there have been any loss of equalization between the various slave hydraulic systems for any cause whatsoever, there will be a reequalization of the operation of these slave systems at this time, i.e. when all hydraulic motors are in the FIG. 4 position. Thus, when the main cylinder 47 is again actuated to raise the platform, the platform will be level because this equalization is maintained by the motors moving toward the FIG. 5 position and cutting off the conduit 39 from each motor.

I claim:

1. In a lift for a swimming pool or the like comprising a body defining the pool and having water therein, said lift including a vertically moving platform within the pool which can be raised and lowered through the water in the pool, and power means to vertically move the platform in the pool, the improvement wherein said power means comprises:

a plurality comprising a given number of spaced hydraulic rams connected to the platform and body for vertically moving the platform, a corresponding number of positive displacement hydraulic motors, each hydraulic motor comprising a cylinder having a piston therein, conduit means connecting each respective motor with a respective ram so that each ram is actuated by a respective motor, motor actuating means connected to said hydraulic motors to actuate the same in unison, said rams, said motors and said conduit means forming a hydraulic system, hydraulic fluid in the hydraulic system, said hydraulic fluid being water compatible with the water in the pool, and means connected to said hydraulic system for automatically supplying make-up water to said system to replace loss of water therein, said make-up water supply means comprising water supply conduit means connected to the piston end of each cylinder so as to be in fluid communication with the system through the interior of the cylinder only when the piston is withdrawn from the cylinder to its maximum extent, and water supply means connected to said water supply conduit means, said hydraulic rams being so connected to said platform and body that the platform is raised when the ram is extended and the platform is lowered when the ram is retracted.

2. In a swimming pool lift as set forth in claim 1, wherein said platform is rectangular having four corners, said given number is four with a respective ram being positioned in each of said corners.

3. In a swimming pool lift as set forth in claim 2, wherein each ram comprises a barrel having a closed and an open end, a piston within the barrel, and a piston rod connected to the ram piston and extending out of the open end of the barrel, said barrels being positioned vertically with the closed end up and being secured to said platform, said piston rods being supported on the portion of the body that forms the bottom of the pool.

4. In a swimming pool lift as set forth in claim 3, wherein said motor actuating means is a second hydraulic system comprising a main hydraulic cylinder member and piston member with one member being connected to all of said hydraulic motors, an electrically driven pump, and hydraulic conduit and control means connecting the pump and main hydraulic cylinder.

5. In a swimming pool lift as set forth in claim 4, wherein said motor actuating means is a second hydraulic system comprising a main hydraulic cylinder member and piston member with one member being connected to all of said hydraulic motors, an electrically driven pump, and hydraulic conduit and control means connecting the pump and main hydraulic cylinder.

6. In a lift for a swimming pool or the like comprising a body defining the pool and having water therein, said lift including a vertically moving platform within the pool which can be raised and lowered through the water in the pool, and power means to vertically move the platform in the pool, the improvement wherein said power means comprises:

a hydraulic ram connected to the platform and body for vertically moving the platform, said hydraulic ram being so connected to said platform and body that the platform is raised when the ram is extended and the platform is lowered when the ram is retracted;

a hydraulic cylinder connected to the ram for actuating the ram, said cylinder comprising a barrel member and a piston member therein;

said ram and cylinder forming a hydraulic system within which is a predetermined amount of hydraulic fluid, said system having water therein as the hydraulic fluid;

means connected to one of said members to reciprocate said one member and thereby operate said ram; and means connected to said hydraulic system for automatically supplying make-up water to said system to replace loss of water therein and thereby maintain said predetermined amount of water, said make-up water supply means comprising water supply conduit means connected to the barrel member at the open end of the barrel member so as to be in fluid communication with the system through the interior of the barrel member only when the piston member is withdrawn from the barrel member to its maximum extent, and water supply means connected to said water supply conduit means;

whereby when said piston member is withdrawn to its maximum extent, said ram is retracted and there is little if any pressure in said hydraulic system for said water supply means to overcome in the filling of the system.

7. In a swimming pool lift as set forth in claim 6, wherein each ram comprises a barrel having a closed and an open end, a piston within the barrel, and a piston rod connected to the ram piston and extending out of the open end of the barrel, said barrels being positioned vertically with the closed end up and being secured to said platform, said piston rods being supported on the portion of the body that forms the bottom of the pool.

8. In a swimming pool lift as set forth in claim 6, wherein said barrel member has a fluid opening at the open end thereof, said conduit means being connected to communicate with said fluid opening, said piston member has an annular groove thereabout, said grove being positioned to be in juxtaposition to said fluid opening when said piston member is withdrawn to said maximum extent, said piston member covering said fluid opening when the piston member is farther in said cylinder member than said maximum withdrawn extent, said piston member having a passageway from said groove to the inner end of the piston member whereby said groove communicates with the interior of said cylinder member.

9. In a swimming pool lift as set forth in claim 8, wherein said make-up water supply means includes a tank for holding water, said tank being at an elevation above said cylinder member, said conduit means communicating with said tank whereby water will flow by gravity from said tank to said cylinder member.

* * * * *